US007789806B2

(12) United States Patent
Yang

(10) Patent No.: US 7,789,806 B2
(45) Date of Patent: Sep. 7, 2010

(54) SCISSORS-LIKE EXERCISING APPARATUS

(76) Inventor: Chung-Chin Yang, No. 5, Guoguang St., Taoyuan City, Taoyuan County 330 (TW)

( * ) Notice: Subject to any disclaimer, the term of this patent is extended or adjusted under 35 U.S.C. 154(b) by 149 days.

(21) Appl. No.: 12/166,890

(22) Filed: Jul. 2, 2008

(65) Prior Publication Data

US 2010/0004103 A1 Jan. 7, 2010

(51) Int. Cl.
*A63B 22/00* (2006.01)

(52) U.S. Cl. ..... 482/51; 482/66; 482/70

(58) Field of Classification Search ..... 482/51–53, 482/57, 61, 62, 66, 70, 79, 80; 601/27; 434/247
See application file for complete search history.

(56) References Cited

U.S. PATENT DOCUMENTS 1,991,782 A * 2/1935 Bloomquist ..... 280/218
2,978,258 A * 4/1961 Gabrielson ..... 280/218
3,566,861 A * 3/1971 Weiss ..... 601/27
3,584,871 A * 6/1971 Kelmon et al. ..... 482/123
4,432,543 A * 2/1984 Normandin ..... 482/131
4,645,200 A * 2/1987 Hix ..... 482/62
4,869,494 A * 9/1989 Lambert, Sr. ..... 482/60
5,306,218 A * 4/1994 Huang Chen ..... 482/72
5,496,237 A * 3/1996 Hensley ..... 482/57
5,690,589 A * 11/1997 Rodgers, Jr. ..... 482/57
5,695,434 A * 12/1997 Dalebout et al. ..... 482/96
5,720,701 A * 2/1998 Truini ..... 482/126
6,220,990 B1 * 4/2001 Crivello ..... 482/51
6,277,055 B1 * 8/2001 Birrell et al. ..... 482/52
6,821,232 B1 * 11/2004 Wang et al. ..... 482/52
7,179,201 B2 * 2/2007 Rodgers, Jr. ..... 482/52
7,244,217 B2 * 7/2007 Rodgers, Jr. ..... 482/52
7,344,480 B2 * 3/2008 Maresh et al. ..... 482/52

* cited by examiner

*Primary Examiner*—Glenn Richman
(74) *Attorney, Agent, or Firm*—Chun-Ming Shih

(57) ABSTRACT

A scissors-like exercising apparatus includes two bodies intersecting with each other, a pivoting unit located between the two bodies, and two sliding units coupled to lower ends of the two bodies. To operate the present invention, the user grasps the tops of the two bodies and stands on the sliding units to retract and extend the two bodies inward and outward like the operation of a pair of scissors.

20 Claims, 7 Drawing Sheets

SCISSORS-LIKE EXERCISING APPARATUS

BACKGROUND OF THE INVENTION

1. Field of the Invention

This invention relates to a scissors-like exercising apparatus, and more particularly to an exercising apparatus having two bodies intersecting with each other, a pivoting unit located between the two bodies and two sliding units coupled to lower ends of the two bodies. To operate the present invention, the user grasps the tops of the two bodies and stands on the sliding units to retract and extend the two bodies inward and outward like the operation of a pair of scissors.

2. Description of the Prior Art

Nowadays, people are busy to work and there are not sufficient outdoor exercising facilities. Most people buy exercising apparatuses to do exercise at home. People are no more interested to buy exercising apparatuses like jogging machines, rowing machines, treadmills, and so on which have been on the market for a long time. It is necessary to develop innovated structures so as to satisfy consumers' curiousness.

Conventional exercise equipment for front and back movement is unable to move transversely. Accordingly, the inventor of the present invention has devoted himself based on his many years of practical experiences to the development of a new exercising apparatus for doing the splits.

SUMMARY OF THE INVENTION

The purpose of the present invention is to provide an innovated exercising apparatus which is a scissors-like apparatus to retract and extend transversely to do exercise for the body and the limbs.

To achieve the purpose of the present invention, there is provided a scissors-like exercising apparatus comprising a first body, being a lengthwise rod; a second body, being a lengthwise rod, the second body intersecting with the first body; a pivoting unit, coupled to an intersection section of the first body and the second body for providing variation of retraction and extension of the first body and the second body; and two sliding units, coupled to lower ends of the first body and the second body, respectively.

DETAILED DESCRIPTION OF THE INVENTION

Figure 1:
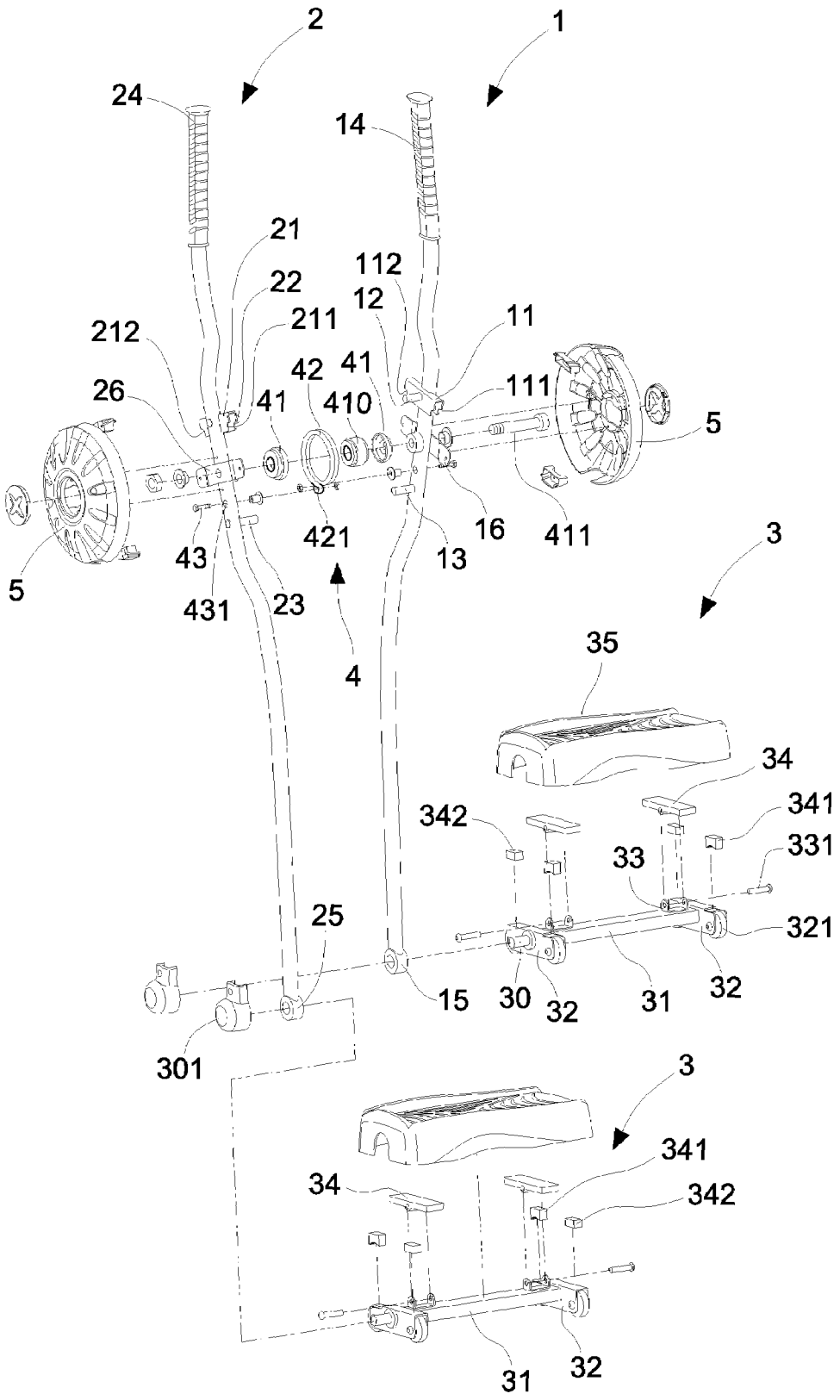
FIG. 1 is an exploded view of a preferred embodiment of the present invention.
Figure 2:
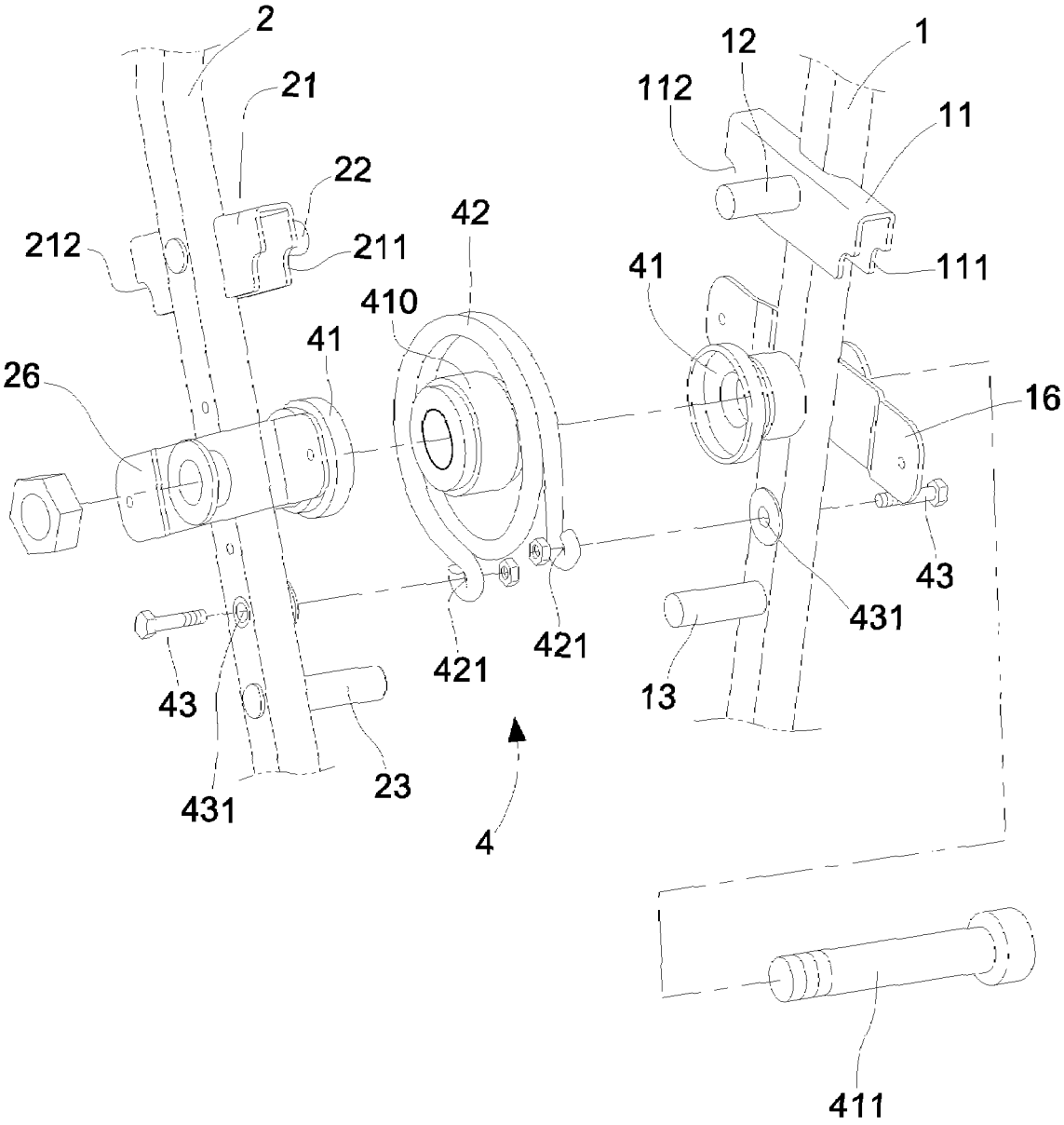
FIG. 2 is a partially enlarged view of FIG. 1.

As shown in FIGS. 1 and 2, a scissors-like exercising apparatus in accordance with a preferred embodiment of the present invention comprises a first body 1, a second body 2, two sliding units 3, and a pivoting unit 4.

The first body 1 is a lengthwise rod. A sleeve 41 is provided at a middle section of the first body 1. A protruding board 11 is transversely provided near the middle section of the first body 1. The protruding bard 11 is formed with a pair of stoppers 111 and 112 at two opposite ends thereof. An upper block 12 protrudes from an inner side of the protruding board 11. A lower block 13 is provided near the middle section of the first body 1. A grip 14 is provided at an upper end of the first body 1, and a connecting ring 15 is provided at a lower end of the first body 1.

The second body 2 is a lengthwise rod corresponding to the first body 1. Another sleeve 41 is provided at a middle section of the second body 2. A protruding board 21 is transversely provided near the middle section of the second body 2. The protruding board 21 is formed with a pair of stoppers 211 and 212 at two opposite ends thereof. An upper block 22 protrudes from an inner side of the protruding board 21. A lower block 23 is provided near the middle section of the second body 2. A grip 24 is provided at an upper end of the second body 2, and a connecting ring 25 is provided at a lower end of the second body 2.

The two sliding units 3 are coupled to the connecting rings 15 and 25 of the first body 1 and the second body 2, respectively. Each of the sliding units 3 comprises a base 31 and two caster bases 32. Each of the caster bases 32 is provided with a plurality of casters 321. One of the casters 321 is exposed and not covered by the caster base 32. A shaft base 33 is provided on the base 31 for insertion of a shaft 331 to connect with a connecting board 34. The connecting board 34 is able to change its angle with respect to the base 31. A blocking member 341 and a pad 342 are provided underneath the connecting board 34. The blocking member 341 is located on the caster 321 which is not covered by the caster base 32. The pad 342 is located on the caster base 32. A coupling member 30 is provided on a side edge of the sliding unit 3. The coupling member 30 is inserted through the connecting ring 15 (or the connecting ring 25) to engage with a cover 301 so that the sliding unit 3 is connected to the bottom of the first body 1 or to the bottom of the second body 2. Each of the sliding units 3 further comprises a pedal 35 on the top of the connecting board 34.

The pivoting unit 4 is coupled to the intersecting section of the first body 1 and the second body 2. The pivoting unit 4 comprises the sleeves 41 disposed at the middle sections of the first body 1 and the second body 2, a bearing 410 located between the two sleeves 41, and a bolt 411 inserting through the bearing 410. The pivoting unit 4 further comprises a resilient member 42 having two ends 421 connected to fixing holes 431 of the first body 1 and the second body 2 with fasteners 43, respectively. The resilient member 42 is a circular spring.

Figure 3:
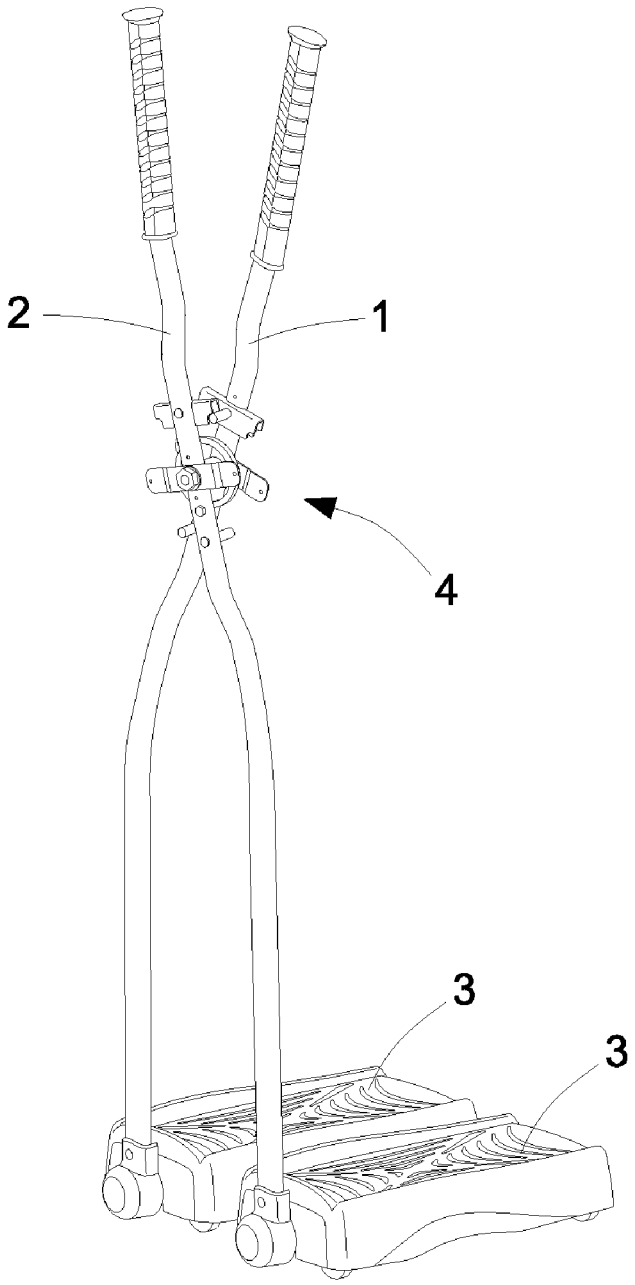
FIG. 3 is a perspective view of the preferred embodiment of the present invention in a retracted state.
Figure 4:
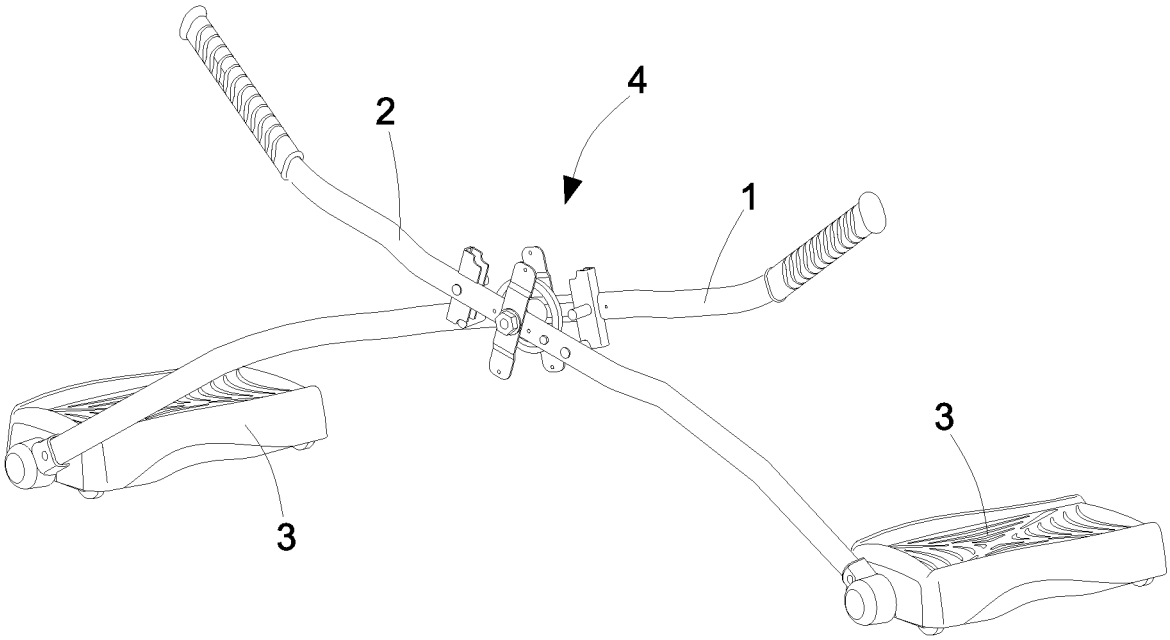
FIG. 4 is a perspective view of the preferred embodiment of the present invention in an extended state.

FIG. 3 is a perspective view of the present invention in a retracted state. FIG. 4 is a perspective view of the present invention in an extended state. FIGS. 3 and 4 show the operation of the present invention like a pair of scissors.

Figure 5:
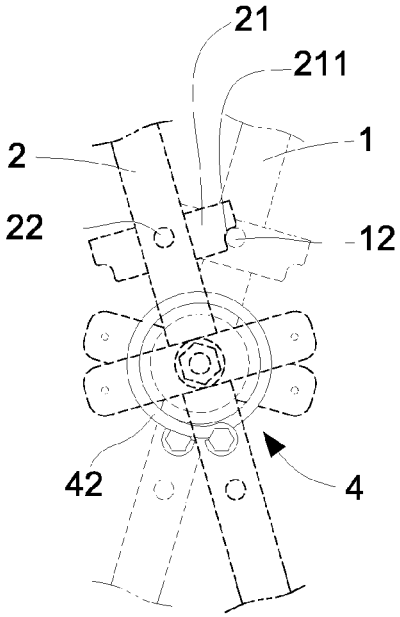
FIG. 5 is an illustrating view of a pivoting unit of the preferred embodiment of the present invention in a retracted state.

As shown in FIGS. 3 and 5, when the first body 1 and the second body 2 are retracted inward, the upper block 12 of the first body 1 will engage with the stopper 211 of the protruding board 21 of the second body 2 while the upper block 22 of the second body 2 will engage with the stopper 112 of the protruding board 11 of the first body 1, as shown in FIG. 2, to control the terminal of the retraction. This design prevents the first body 1 and the second body 2 from colliding or be jammed because of undue retraction.

Figure 6:
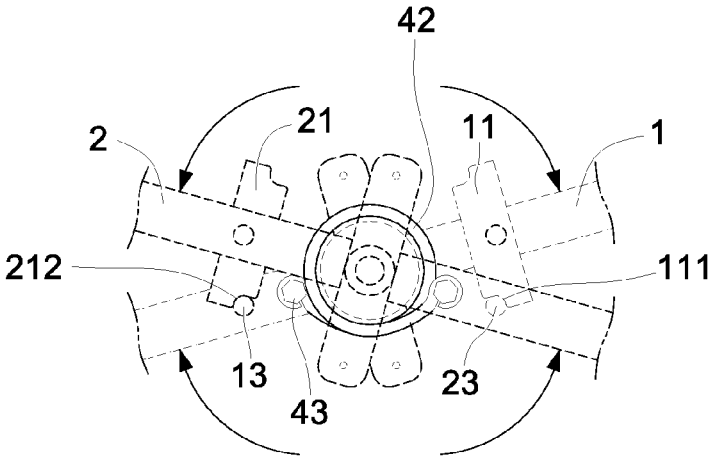
FIG. 6 is an illustrating view of the pivoting unit of the preferred embodiment of the present invention in an extended state.

As shown in FIGS. 4 and 6, when the first body 1 and the second body 2 are extended outward, the lower block 13 of the first body 1 will engage with the stopper 212 of the protruding board 21 of the second body 2 while the lower block 23 of the second body 2 will engage with the stopper 111 of the protruding board 11 of the first body 1 to control the terminal of the extension.

As shown in FIG. 6, the resilient member 24 of the present invention is located between the first body 1 and the second body 2. When the first body 1 and the second body 2 are not forced to extend outward, the resilience of the resilient member 24 will facilitate the first body 1 and the second body 2 to return the retracted state, as shown in FIG. 5.

Figure 7:
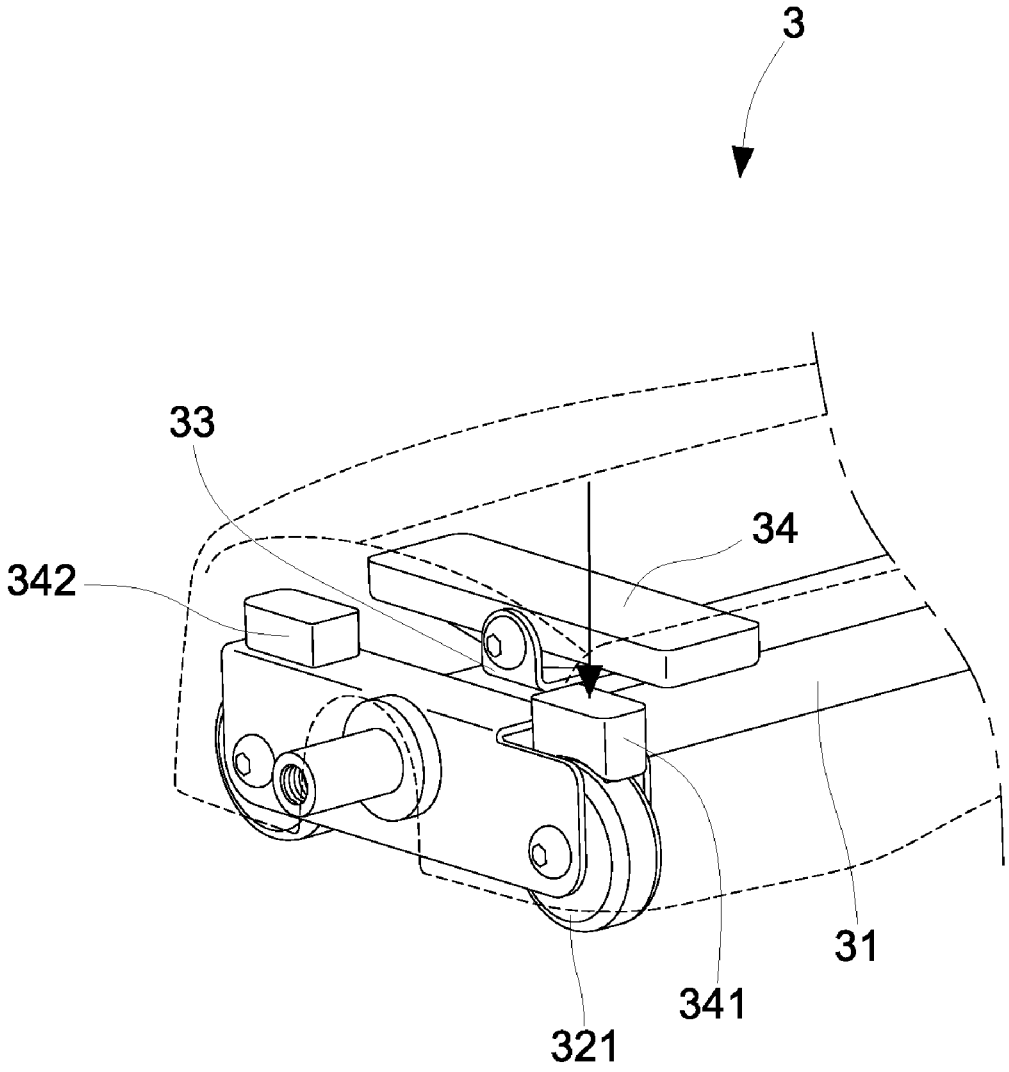
FIG. 7 is a partially enlarged view of a sliding unit of the preferred embodiment of the present invention.

As shown in FIG. 7, the connecting board 34 of the sliding unit 3 is able to change its angle with respect to the base 31 via the caster base 33 so that the pedal 35 on the connecting board 34 is able to change its angle with respect to the base 31. When the pedal 35 is tilted toward the right of the drawing, the blocking member 341 will be pressed downward to be contact with the caster 321 which is not covered by the caster base 32 so as to provide a brake function. When the pedal 35 is tilted toward the left of the drawing, the blocking member 341 will rise and not be contact with the caster 321 which is not covered by the caster base 32 so that the pedal 35 is in a level position via the support of the pad 342.

Figure 8:
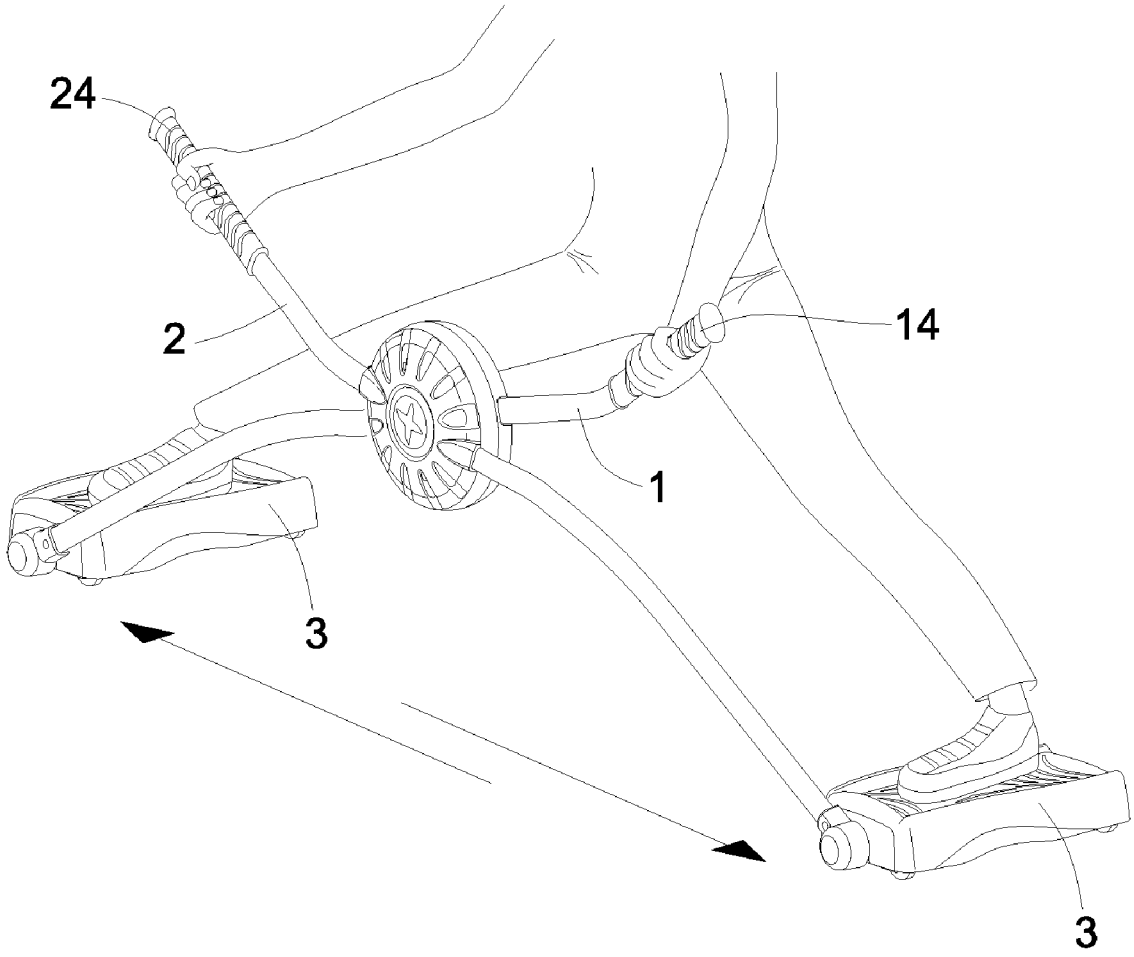
FIG. 8 is a perspective view of the preferred embodiment of the present invention in use.

To operate the present invention, as shown in FIG. 8, the user grasps the grips 14 and 24 of the first body 1 and the second body 2 and stands on the two sliding units 3 to reciprocate the first body 1 and the second body 2 inward and outward like the operation of a pair of scissors.

When the present invention is in use, the pedal 35 of the sliding unit 3 is able to be tiled to provide a brake function when necessary, as shown in FIG. 7.

As shown in FIG. 1, the present invention further comprises a pair of shells 5 to cover the pivoting unit 4 and beautify the appearance of the present invention. The shells 5 are coupled to locking boards 16 and 26 of the first body 1 and the second body 2.

Although the invention has been shown and described with respect to the preferred embodiment, it will be understood by those skilled in the art that various changes and modifications may be made without departing from the spirit and scope of the invention as defined in the following claims.

What is claimed is:

1. A scissors-like exercising apparatus, comprising:

a first body, being a lengthwise rod;

a second body, being a lengthwise rod, the second body intersecting with the first body;

a pivoting unit, coupled to an intersection section of the first body and the second body for providing variation of retraction and extension of the first body and the second body; and two sliding units, coupled to lower ends of the first body and the second body, respectively, wherein a pair of protruding boards is transversely provided near the middle sections of the first body and the second body, each of the protruding boards having stoppers at two opposite ends thereof and an upper block protruding from an inner side thereof, a pair of lower blocks being provided near the middle sections of the first body and the second body.

2. The scissors-like exercising apparatus as recited in claim 1, wherein a pair of sleeves is provided on middle sections of the first body and the second body; a bearing is provided between the pair of sleeves; and a bolt is provided to connect with the pair of sleeves and the bearing.

3. The scissors-like exercising apparatus as recited in claim 1, wherein each of the first body and the second body comprises a grip at an upper end thereof.

4. The scissors-like exercising apparatus as recited in claim 1, wherein each of the first body and the second body comprises a connecting ring at a lower end thereof.

5. The scissors-like exercising apparatus as recited in claim 4, wherein the connecting ring is connected with the sliding unit.

6. The scissors-like exercising apparatus as recited in claim 5, wherein each of the sliding units is provided with a number of casters at a lower end thereof.

7. The scissors-like exercising apparatus as recited in claim 5, wherein each of the sliding units comprises a base and two caster bases, each of the caster bases being provided with a number of casters, one of the casters being exposed, a shaft base being provided on the base for insertion of a shaft to connect with a connecting board, the connecting board being able to change its angle with respect to the base, a blocking member and a pad being provided underneath the connecting board, the blocking member being located on the caster which is exposed, the pad being located on the caster base, a coupling member being provided on a side edge of the sliding unit to be inserted through the connecting ring to connect with the lower end of the first body or to connect with the lower end of the second body.

8. The scissors-like exercising apparatus as recited in claim 1, wherein the sliding unit is provided with a number of casters at a lower end thereof.

9. The scissors-like exercising apparatus as recited in claim 1, wherein each of the sliding units comprises a base and two caster bases, each of the caster bases being provided with a number of casters, one of the casters being exposed, a shaft base being provided on the base for insertion of a shaft to connect with a connecting board, the connecting board being able to change its angle with respect to the base, a blocking member and a pad being provided underneath the connecting board, the blocking member being located on the caster which is exposed, the pad being located on the caster base.

10. The scissors-like exercising apparatus as recited in claim 1, wherein a coupling member is provided on a side edge of the sliding unit and each of the first body and the second body is provided with a connecting ring at a lower end thereof to connect with the coupling member.

11. The scissors-like exercising apparatus as recited in claim 1, wherein the pivoting unit further comprises a resilient member having two ends connected to fixing holes provided on the first body and the second body with fasteners, the resilient member being a circular spring.

12. A scissors-like exercising apparatus, comprising:

a first body, being a lengthwise rod;

a second body, being a lengthwise rod, the second body intersecting with the first body;

a pivoting unit, coupled to an intersection section of the first body and the second body for providing variation of retraction and extension of the first body and the second body; and two sliding units, coupled to lower ends of the first body and the second body, respectively, wherein each of the sliding units comprises a base and two caster bases, each of the caster bases being provided with a number of casters, one of the casters being exposed, a shaft base being provided on the base for insertion of a shaft to connect with a connecting board, the connecting board being able to change its angle with respect to the base, a blocking member and a pad being provided underneath the connecting board, the blocking member being located on the caster which is exposed, the pad being located on the caster base.

13. The scissors-like exercising apparatus as recited in claim 12, wherein a pair of sleeves is provided on middle sections of the first body and the second body; a bearing is provided between the pair of sleeves; and a bolt is provided to connect with the pair of sleeves and the bearing.

14. The scissors-like exercising apparatus as recited in claim 12, wherein a pair of protruding boards is transversely provided near the middle sections of the first body and the second body, each of the protruding boards having stoppers at two opposite ends thereof and an upper block protruding from an inner side thereof, a pair of lower blocks being provided near the middle sections of the first body and the second body.

15. The scissors-like exercising apparatus as recited in claim 12, wherein each of the first body and the second body comprises a grip at an upper end thereof.

16. The scissors-like exercising apparatus as recited in claim 12, wherein each of the first body and the second body comprises a connecting ring at a lower end thereof.

17. The scissors-like exercising apparatus as recited in claim 16, wherein the connecting ring is connected with the sliding unit.

18. The scissors-like exercising apparatus as recited in claim 12, wherein each of the sliding units is provided with a number of casters at a lower end thereof.

19. The scissors-like exercising apparatus as recited in claim 12, wherein a coupling member is provided on a side edge of the sliding unit and each of the first body and the second body is provided with a connecting ring at a lower end thereof to connect with the coupling member.

20. The scissors-like exercising apparatus as recited in claim 12, wherein the pivoting unit further comprises a resilient member having two ends connected to fixing holes provided on the first body and the second body with fasteners, the resilient member being a circular spring.

* * * * *